US005742983A

United States Patent [19]

Lo

[11] Patent Number: 5,742,983

[45] Date of Patent: Apr. 28, 1998

[54] AIRTIGHT CLIP DEVICE FOR INFLATION NOZZLE OF AN AIR BAG

[76] Inventor: Luke Lo, No. 9, Lane 34 Chin Men St., Taipei, Taiwan

[21] Appl. No.: 559,062

[22] Filed: Nov. 16, 1995

[51] Int. Cl.[6] ..... B65D 77/10

[52] U.S. Cl. ..... 24/30.5 R; 24/543; 29/453

[58] Field of Search ..... 24/30.5 R, 487, 24/543, 559; 446/222; 251/10; 383/63, 68; 29/453

[56] References Cited

U.S. PATENT DOCUMENTS

| | | | |
|---|---|---|---|
| 1,201,045 | 10/1916 | Head | 446/222 |
| 2,070,939 | 2/1937 | Whitney | 24/543 X |
| 3,154,281 | 10/1964 | Frank | 29/453 X |
| 3,266,711 | 8/1966 | Song | 24/30.5 R X |
| 4,650,925 | 3/1987 | Coldren | 24/543 X |
| 4,834,730 | 5/1989 | Holtermann et al. | 24/543 X |
| 5,194,309 | 3/1993 | Knudsen . | |
| 5,212,850 | 5/1993 | Rerolle | 24/543 X |
| 5,301,392 | 4/1994 | Richman | 24/559 X |

*Primary Examiner*—James R. Brittain

[57] ABSTRACT

An airtight clip device for inflation nozzle of an air bag. The clip device includes a clip seat, a clip board and a folding section foldably connecting the clip board with the clip seat. The clip seat is disposed with two hook edges on two sides and multiple clip teeth are arranged on the clip seat between the hook edges. Multiple clip teeth are formed on the clip board in cooperation with the clip teeth of the clip seat. The clip board is foldable onto the clip seat to be fixedly inserted between the hook edges thereof with the clip teeth of the clip board engaged with the clip teeth of the clip seat so as to airtightly clip and seal the inflation nozzle.

4 Claims, 8 Drawing Sheets

AIRTIGHT CLIP DEVICE FOR INFLATION NOZZLE OF AN AIR BAG

BACKGROUND OF THE INVENT ION

The present invention relates to an airtight clip device for inflation nozzle of an air bag. The clip device includes a clip seat, a clip board and a folding section foldably connecting the clip board with the clip seat. The clip seat is disposed with two hook edges on two sides and multiple clip teeth between the hook edges. Multiple cooperative clip teeth are formed on the clip board, so that the clip board is foldable onto the clip seat to be fixedly inserted between the hook edges thereof with the clip teeth of the clip board engaged with the clip teeth of the clip seat so as to airtightly clip and seal the inflation nozzle.

FIGS. 1 and 2 show a conventional clip device for inflation nozzle of an air bag, wherein the clip device includes a clip seat 41, a clip body 42 and a folding section 43 foldably connecting the clip body 42 with the clip seat 41. The clip body 42 is disposed with a clip strip 421 and the clip seat 41 is formed with a clip channel 411 for snugly engaging with the clip strip 421. In use, the inflation nozzle 50 of the air bag is transversely placed between the clip seat 41 and the clip body 42 and the clip body 42 is folded onto the clip seat 41 with the clip strip 421 inserted into the clip channel 411 so as to clip and seal the inflation nozzle 50.

Several shortcomings exist in such structure as follows:

1. After a period of use, the clip strip 421 will be unable to tightly engage with the clip channel 411 due to abrasion. This makes the clip body 42 tend to loosen from the the clip seat 41 and thus the inflation nozzle 50 subjected to the high pressure of the air within the air bag is apt to bound the clip body 42 away from the clip seat 41, causing deflation of the air bag.
2. The inflation nozzle 50 is transversely clipped between the clip seat 41 and the clip body 42 so that the clipping area for the inflation nozzle 50 is quite small and the sealing effect for the inflation nozzle is very poor. Accordingly, even the clip body 42 is kept engaged with the clip seat 41, the air within the air bag may still pass through the inflation nozzle and escape therefrom.

SUMMARY OF THE INVENTION

It is therefore a primary object of the present invention to provide an airtight clip device for inflation nozzle of an air bag. The clip device includes a clip seat, a clip board and a folding section foldably connecting the clip board with the clip seat. The clip seat is disposed with two hook edges on two sides and multiple clip teeth transversely arranged on the clip seat between the hook edges. Multiple clip teeth are transversely formed on the clip board in cooperation with the clip teeth of the clip seat. The inflation nozzle is first longitudinally placed over the clip seat and the clip board and then the clip board is folded onto the clip seat to be fixedly inserted between the hook edges thereof with the clip teeth of the clip board engaged with the clip teeth of the clip seat so as to firmly and airtightly clip and seal the inflation nozzle.

It is a further object of the present invention to provide the above clip device in which each hook edge has an arch top face which aids in insertion of the clip board between the hook edges. Multiple longitudinal parallel channels are formed on a bottom face of the clip seat. When the clip board is inserted between the hook edges of the clip seat, the channels permit the hook edges to expand outward with the clip seat curved and deformed.

It is still a further object of the present invention to provide the above clip device in which the clip board is formed with arch projections on two sides opposite to the clip teeth. When the clip board is inserted between the hook edges, the arch projections are located under and snugly engaged with the hook edges without slippage. Therefore, even though the inflation nozzle is subject to a great pressure from the air within the air bag, the clip board is still firmly engaged with the clip seat to airtightly clip and seal the inflation nozzle without loosening and detachment.

The present invention can be best understood through the following description and accompanying drawings, wherein:

DETAILED DESCRIPTION OF THE PREFERRED EMBODIMENT

Figure 1:
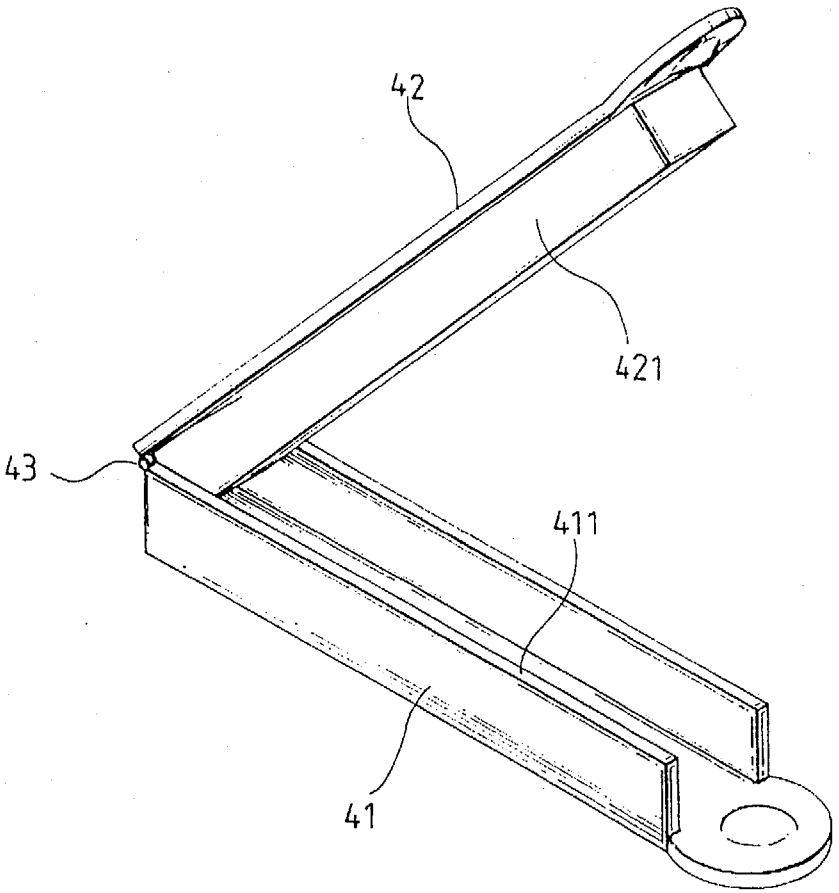
Prior Art Fig. 1
FIG. 1 shows the structure of a conventional clip device for inflation nozzle of an air bag.
Figure 2:
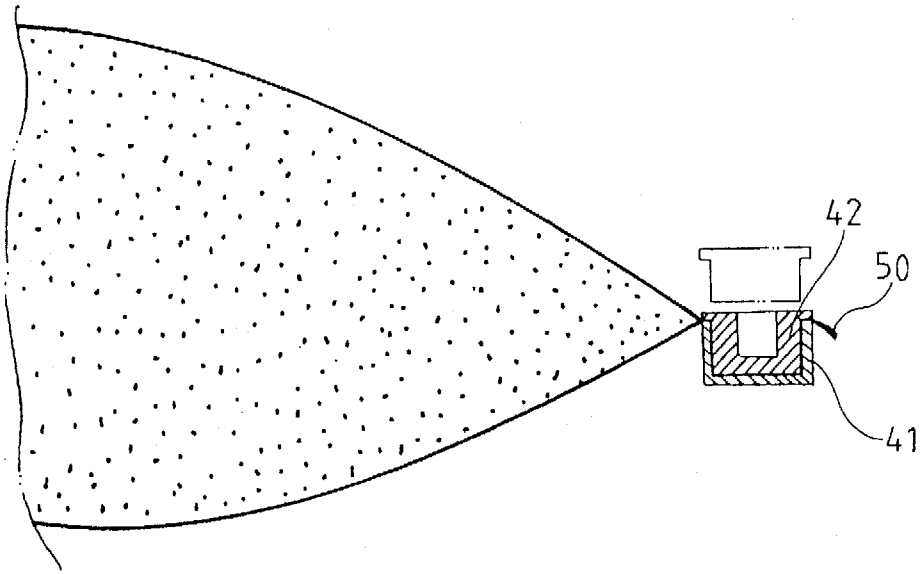
Prior Art Fig. 2
FIG. 2 shows the application of the conventional clip device of FIG. 1.
Figure 3:
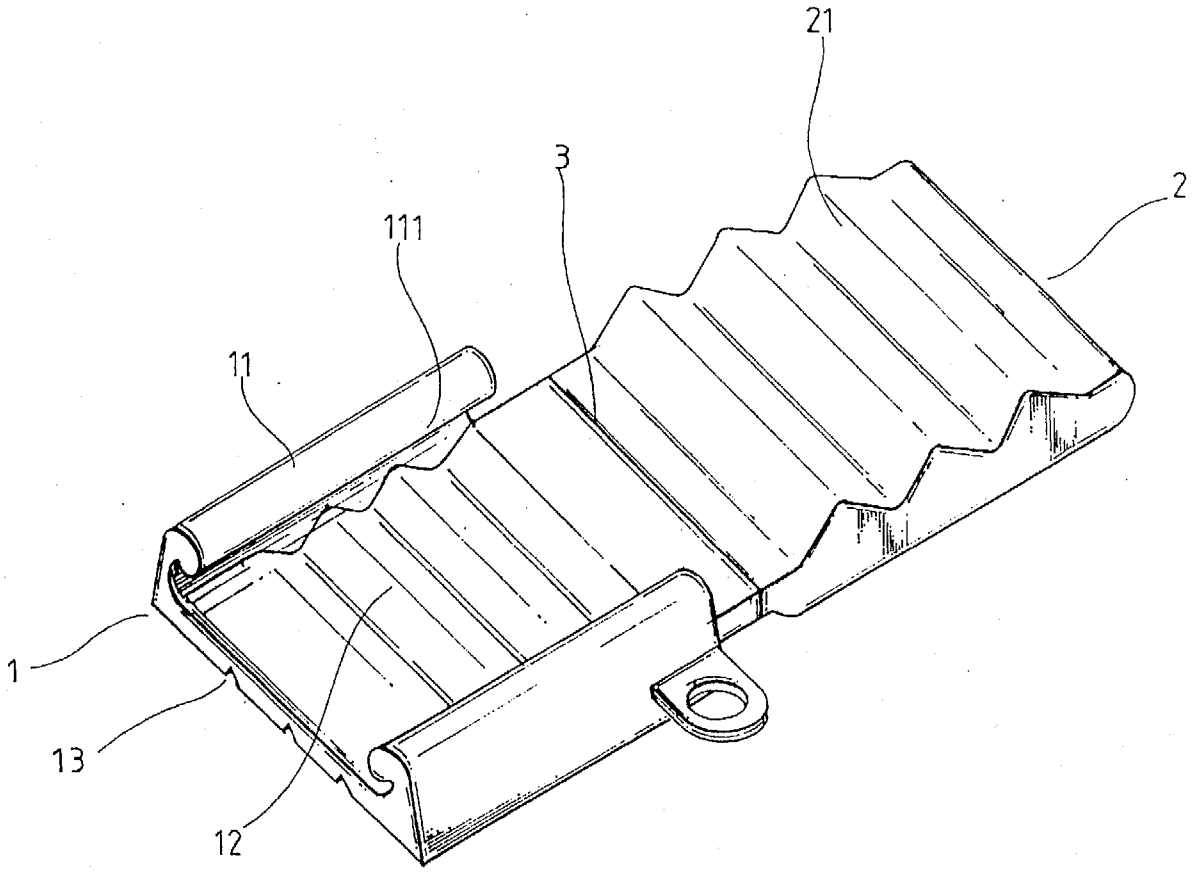
FIG. 3 is a perspective view of the clip device of the present invention.

Please refer to FIG. 3. The clip device of the present invention includes a clip seat 1, a clip board 2 and a folding section 3. The clip seat 1 is disposed with two hook edges 11 on two sides and multiple strip-like clip teeth 12 transversely arranged on a top face of seat 1 between the hook edges 11. Each hook edge 11 has an arch top face 111. Multiple longitudinal parallel channels 13 are formed on a bottom face of the clip seat 1. The clip board 2 has a width between the width of the clip seat 1 and the space between the hook edges 11. The clip board 2 is formed with multiple transverse clip teeth 21 on a top face of seat 1 in cooperation with the clip teeth 12 of the clip seat 1. The folding section 3 connects the clip seat 1 and the clip board 2 and permits the top face of board 2 to be folded onto the top face of seat 1, thus disposing teeth 21 into engagement between teeth 12, as shown in FIG. 9.

Figure 4:
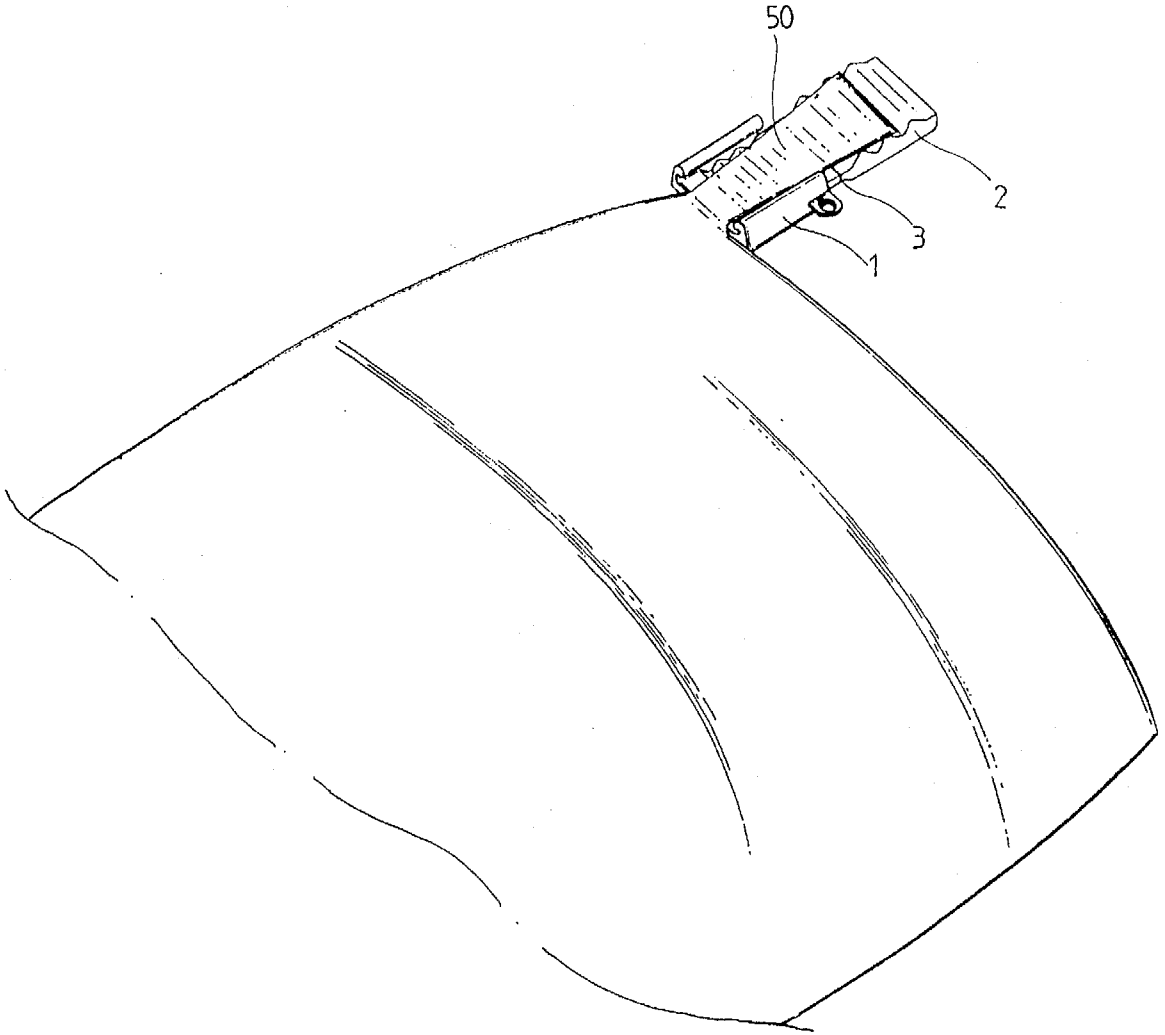
FIGS. 4 and 5 show the application of the clip device of FIG. 3.
Figure 5:
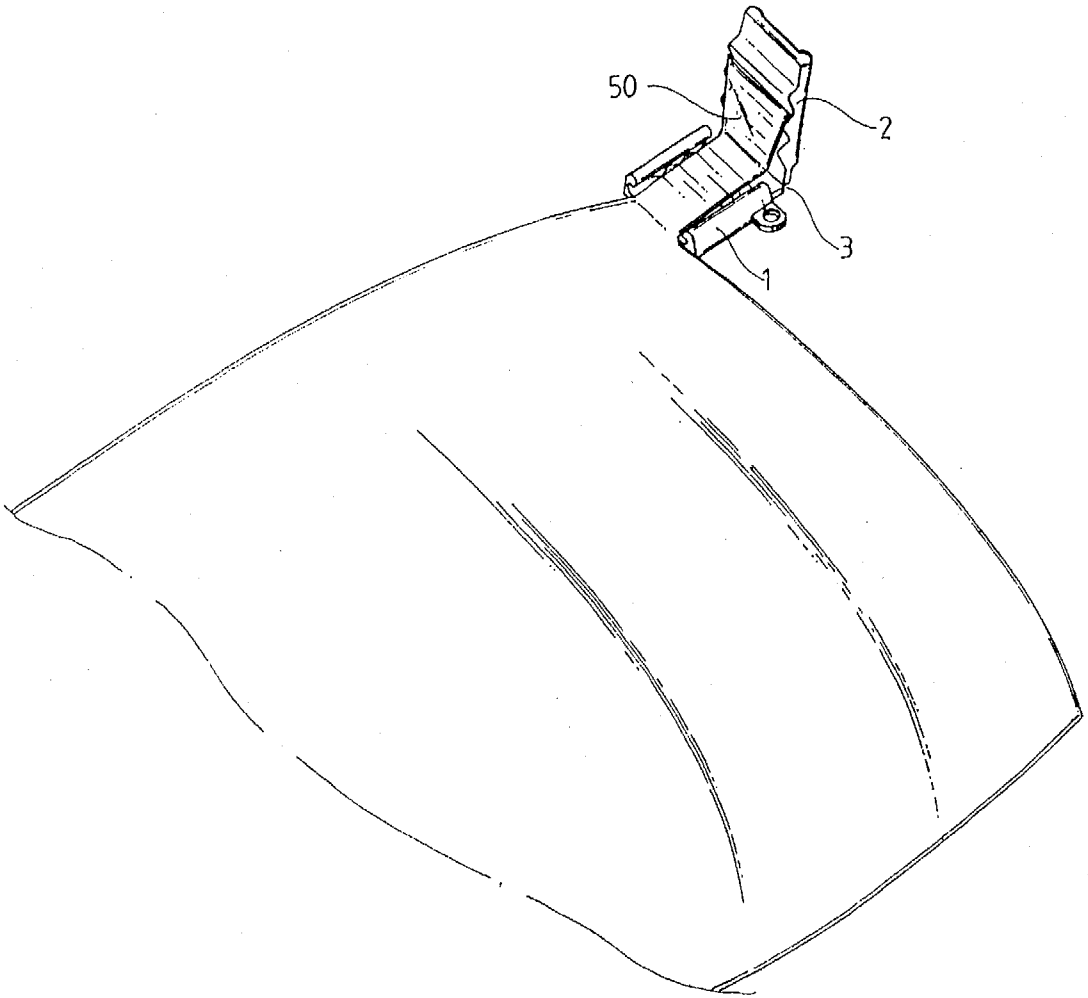
Figure 6:
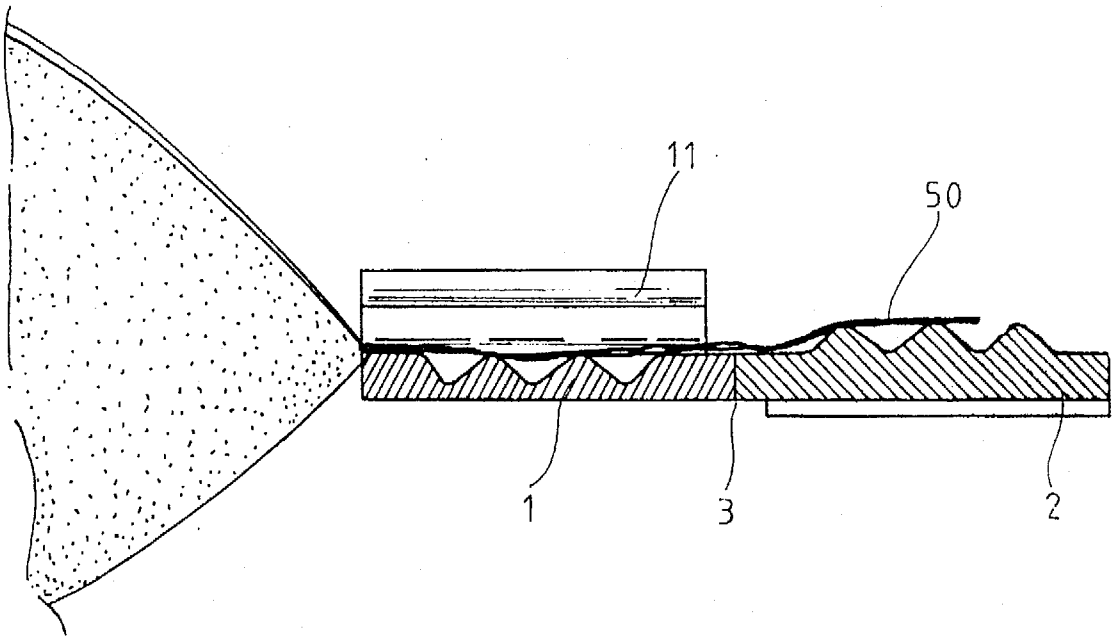
FIG. 6 is a sectional view according to FIG. 4.

FIGS. 4, 5 and 6 show the operation of the clip device of the present invention. When used, the clip seat 1 and the clip board 2 are unfolded with the inflation nozzle 50 of the air bag longitudinally placed over the clip seat 1 and the clip board 2. Then the clip board 2 as well as the inflation nozzle 50 thereover are folded onto the clip seat 1 and inserted between the hook edges 11 thereof. At this time, the clip teeth 21 of the clip board 2 are engaged with the clip teeth 12 of the clip seat 1 to clip and airtightly seal the inflation nozzle 50.

Figure 7:
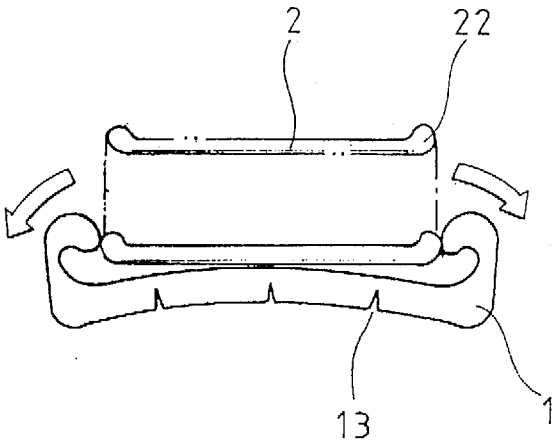
FIG. 7 is a front view showing that the clip seat is deformed when the clip board is inserted thereinto.
Figure 8:
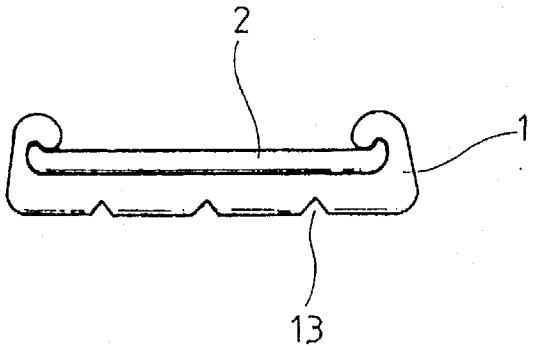
FIG. 8 is a front view showing that the clip board is completely located within the clip seat.
Figure 9:
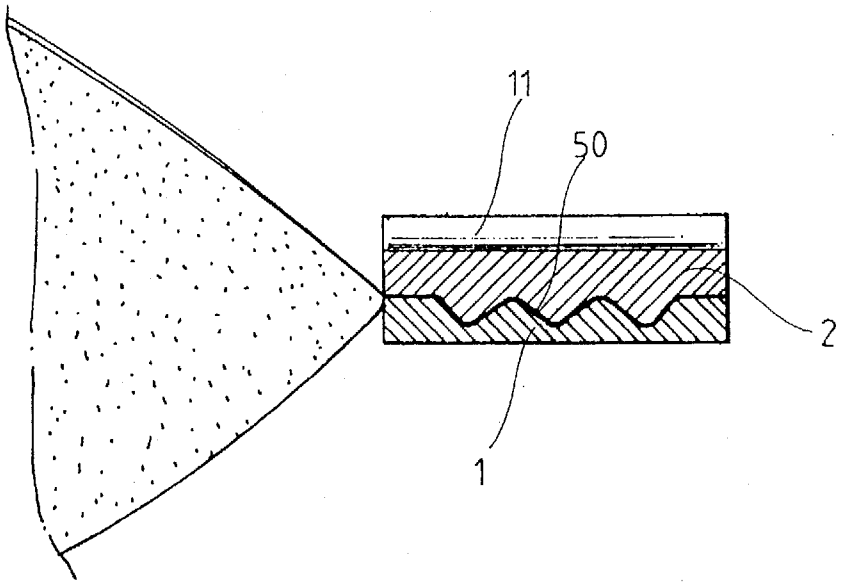
FIG. 9 is a side sectional view showing that the inflation nozzle is clipped and sealed by the clip seat and the clip board.

FIGS. 7, 8 and 9 show that the inflation nozzle is clipped between the clip seat 1 and the clip board 2, wherein when the clip board 2 is folded onto and inserted into the clip seat 1, the channels 13 of the clip seat 1 permit the hook edges 11 thereof to expand outward with the clip seat 1 curved and deformed. The arch top faces 111 of the hook edges 11 aid in insertion of the clip board 2 between the hook edges 11. The clip board 2 is formed with arch projections 22 on two sides opposite to the clip teeth 21. When the clip board 2 is inserted between the hook edges 11, the arch projections 22 are located under and snugly engaged with the hook edges 11 without slippage. Therefore, even though the inflation nozzle 50 is subject to a great pressure from the air within the airbag, the clip board 2 is still firmly engaged with the clip seat 1 to airtightly clip the inflation nozzle without loosening and detachment.

Accordingly, the clip device of the present invention can reliably airtightly seal the inflation nozzle of the air bag. It should be appreciated that many modifications can be made without departing from the spirit of the present invention. The scope of the present invention should be defined by the appended claims only.

What is claimed is:

1. A clip device for the inflation nozzle of an airbag, said clip device comprising:

a) a clip seat having a top face, a bottom face, a pair of sides, a hook edge on each side, and a plurality of channels formed in the bottom face, the channels being parallel to the hook edges;

b) a clip board having a top face;

c) a plurality of first clip teeth formed on the top face of the clip seat and a plurality of second clip teeth formed on the top face of the clip board, the first and second clip teeth being correspondingly engageable together; and d) a folding section connecting the clip seat and the clip board for permitting the clip board to fold into the clip seat and into engagement with the hook edges for airtightly clipping an inflation nozzle between the top faces of the clip seat and clip board.

2. A clip device for the inflation nozzle of an air bag, the clip device comprising:

a) a clip seat having a top face, a bottom face, a pair of sides and a hook edge on side;

b) a clip board having a top face;

c) a plurality of first clip teeth formed on the top face of the clip seat between the hook edges and a plurality of second clip teeth formed on the top face of the clip board, the first and second clip teeth being correspondingly engageable together; and d) a folding section connecting the clip seat and the clip board for permitting the clip board to fold onto the clip seat and into engagement with the hook edges for airtghtly clipping an inflation nozzle between the corresponding first clip teeth of the clip seat and the second clip teeth of the clip board.

3. A clip device for the inflation nozzle of an air bag, the clip device comprising:

a) a clip seat having a top face, a bottom face, a pair of sides, a hook edge on each side, and each hook edge including an arch top face;

b) a clip board having a top face;

c) a plurality of first clip teeth formed on the top face of the clip seat and a plurality of second clip teeth formed on the top face of the clip board, the first and second clip teeth being correspondingly engageable together; and d) a folding section connecting the clip seat and the clip board for permitting the clip board to fold onto the clip seat and into engagement with the hook edges for airtightly clipping an inflation nozzle between the first clip teeth of the clip seat and the second clip teeth of the clip board.

4. A clip device for the inflation nozzle of an air bag, the clip device comprising:

a) a clip seat having a top face, a bottom face, a pair of sides and a hook edge on each side;

b) a clip board having a top face, a bottom face, a pair of sides on the bottom face and an arch projection on each side;

c) a plurality of first clip teeth formed on the top face of the clip seat and a plurality of second clip teeth formed on the top face of the clip board, the first and second clip teeth being correspondingly engageable together; and d) a folding section connecting the clip seat and the clip board for permitting the clip board to fold onto the clip seat and dispose the arch projections of the clip board into engagement with the hook edges of the clip seat for airtightly clipping an inflation nozzle between the first clip teeth of the clip seat and the second clip teeth of the clip board.

* * * * *